US007594475B1

(12) United States Patent
Huang

(10) Patent No.: US 7,594,475 B1
(45) Date of Patent: Sep. 29, 2009

(54) ADJUSTABLE DESK

(76) Inventor: Tsun Hung Huang, 4F-2, No. 428, Sec. 2, Liming Rd., Nantun District, Taichung City 408 (TW)

( * ) Notice: Subject to any disclaimer, the term of this patent is extended or adjusted under 35 U.S.C. 154(b) by 0 days.

(21) Appl. No.: 12/126,950

(22) Filed: May 26, 2008

(51) Int. Cl.
*A47F 5/12* (2006.01)

(52) U.S. Cl. ..... 108/8; 108/10; 297/423.46

(58) Field of Classification Search ..... 108/1, 108/6, 8, 9, 10, 12, 43, 49, 44; 297/423.12, 297/423.24, 423.36, 423.35, 423.39, 423.41, 297/423.44, 423.45, 426.46
See application file for complete search history.

(56) References Cited

U.S. PATENT DOCUMENTS

| | | | | | |
|---|---|---|---|---|---|
| 285,101 | A * | 9/1883 | Benedict | 108/8 |
| 315,665 | A * | 4/1885 | Schneck | 108/8 |
| 356,023 | A * | 1/1887 | Aston | 108/8 |
| 441,792 | A * | 12/1890 | Eyles | 108/8 |
| 468,438 | A * | 2/1892 | Duemer | 108/8 |
| 815,046 | A * | 3/1906 | Sherman | 297/423.46 |
| 1,295,680 | A * | 2/1919 | Benson | 108/4 |
| 1,420,404 | A * | 6/1922 | Beaver | 297/171 |
| 1,770,955 | A * | 7/1930 | Storm | 108/8 |
| 2,775,497 | A * | 12/1956 | Alvarez | 108/146 |
| 2,912,046 | A * | 11/1959 | Fuerst | 297/423.46 |
| 3,163,468 | A * | 12/1964 | Koch | 297/423.46 |
| 3,246,612 | A * | 4/1966 | Ballas | 108/6 |
| 3,289,612 | A * | 12/1966 | Mouw | 108/50.12 |
| 4,873,966 | A * | 10/1989 | Gitter | 297/423.46 |
| 4,901,385 | A * | 2/1990 | Adolphson | 297/423.46 |
| 4,947,763 | A * | 8/1990 | Piorek | 108/8 |
| 5,201,568 | A * | 4/1993 | Christensen, Jr. | 297/423.46 |
| 5,294,180 | A * | 3/1994 | Grimm | 297/423.46 |
| 5,348,377 | A * | 9/1994 | Grosch | 297/423.46 |
| 5,356,203 | A * | 10/1994 | Levasseur et al. | 297/423.46 |
| 5,577,806 | A * | 11/1996 | Ugalde | 297/423.46 |
| 5,765,921 | A * | 6/1998 | Chuang | 297/423.46 |
| 6,682,147 | B1 * | 1/2004 | Leoutsakos | 297/423.46 |

FOREIGN PATENT DOCUMENTS

| | | | |
|---|---|---|---|
| FR | 2635659 | A1 * | 3/1990 |

* cited by examiner

*Primary Examiner*—José V Chen
(74) *Attorney, Agent, or Firm*—Shia Banger

(57) ABSTRACT

An adjustable desk is disclosed, which has a desk board and two supporting legs; each supporting leg includes an upper frame, a lower frame, and fasteners. Both upper frames and lower frames have respective slots, which intersect to form dual intersections for allowing fasteners to penetrate between the intersections, to slide within the two slots, and to position the upper frame with the lower frame. Raising or tilting the desk board to the desired height and slope is achieved via tightening or loosening the fasteners; the supporting leg has an adjustable apparatus disposed thereon for users to hold onto.

5 Claims, 6 Drawing Sheets

ADJUSTABLE DESK

BACKGROUND OF THE INVENTION

1. Field of the Invention

The present invention relates to a desk design, in particular to an adjustable desk.

2. Description of the Related Art

Typically, the conventional desk commonly consists of a desk board and a plurality of side legs secured to the desk board; however, those fixed legs render the desk board unable to be adjusted at the desire height and slope levels and incurs some problems. For instance, the desk may not be suitable for all pupils or adults due to the restriction on the settled height or slope of the legs, which hence results of the using inconvenience or even affects users' postures.

In this manner, desks with adjustable design are produced to improve the deficiencies of the conventional desk. Most of them mainly consist of the barometrical sticks or the telescopic stems secured to the desk board so as to adjust the desk board at a certain height via driving those stem structures. Nevertheless, the conventional adjustable desks merely control the height of the desk board but still need other auxiliary devices for the purpose of slope adjustments of the desk board. That is, the conventional adjustable desk requires complex configurations and operations for raising and simultaneously tilting the desk board, hence still casing the inconvenience.

SUMMARY OF THE INVENTION

The object of the present invention is to provide an adjustable desk conducive to positioning the desk board at the desired height and slope levels in response to users' demands, thereby obtaining a facile and quick adjustment and increasing the using convenience.

The adjustable desk in accordance with the present invention essentially comprises a desk board and a pair of supporting legs; wherein, each supporting leg provides with an upper frame fastened to the board, a lower frame pivoted to the upper frame, and a plurality of fasteners connecting the two frames. The upper and lower frames especially have separative slots defined thereon for generating dual intersections while the two frames are intersected, thereby permitting the fasteners to slide along the slots and further position the frames. Consequently, users handily adjust the desk board at the desired height and slope levels via tightening and loosening the fasteners so as to increase the convenience of using.

The advantages of the present invention over the known prior arts will become more apparent to those of ordinary skilled in the art by reading the following descriptions with the relating drawings.

DETAILED DESCRIPTION OF THE PREFERRED EMBODIMENTS

Figure 1:
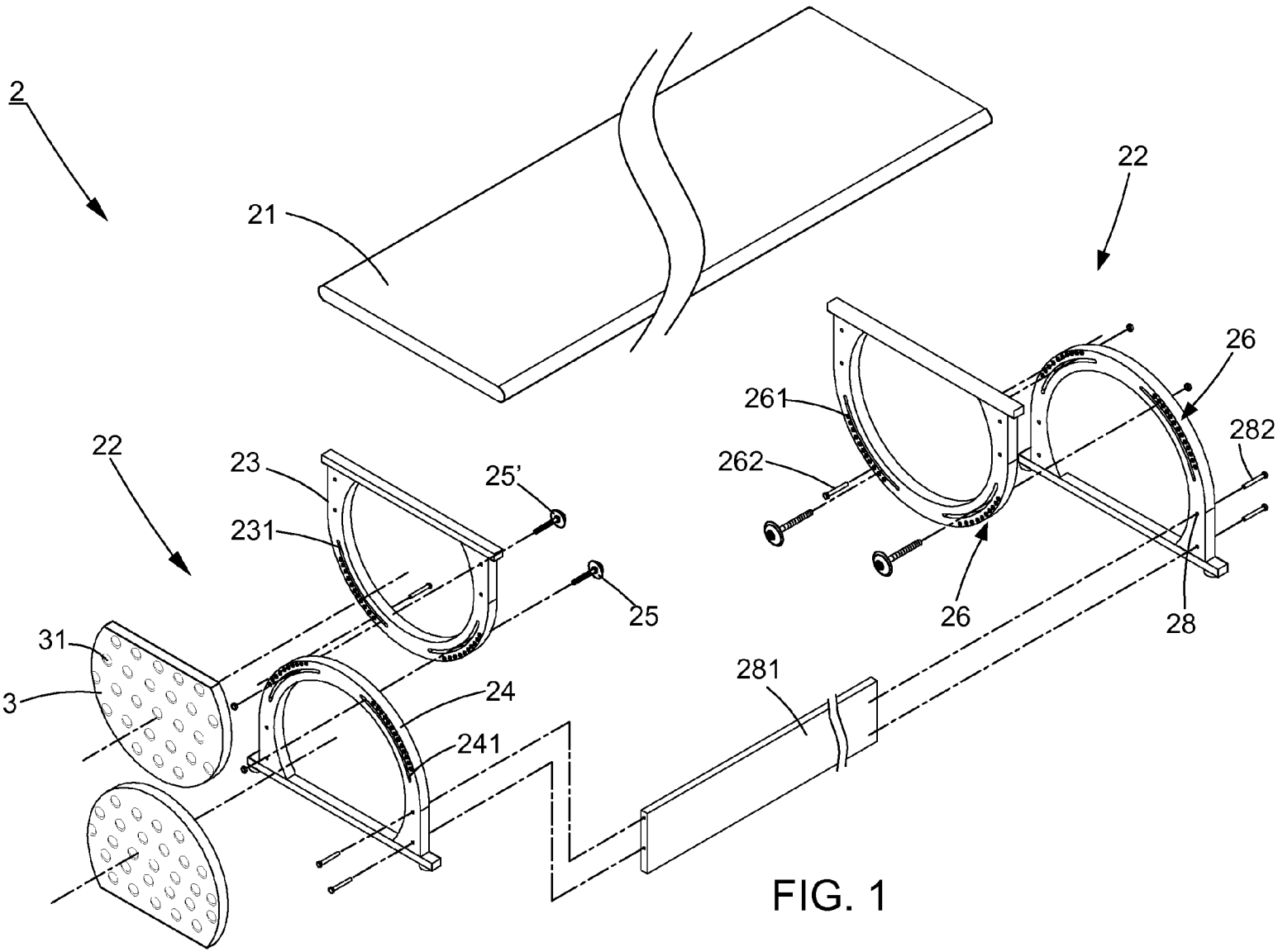
FIG. 1 is an exploded view showing a first preferred embodiment of the present invention.

Before describing in greater detail, it should note that the like elements are denoted by the similar reference numerals throughout the disclosure.

Referring to FIG. 1, an adjustable desk 2 of the first preferred embodiment comprises a desk board 21 and a pair of supporting legs 22 separately extending from both sides of the desk board 21, and each of the supporting legs 22 provides with an upper frame 23 fastened to the desk board 21, a lower frame 24 pivotally mounted on the upper frame 23, and a plurality of fasteners 25,25' connecting both the upper frame 23 and the lower frame 24; wherein, the upper frame 23 and the lower frame 24 respectively has a first slot 231 and a second slot 241 defined thereon, and the two slots 231,241 intersect with each other to generate dual intersections while the two frames 23,24 are overlapped. Additionally, the fasteners 25,25', adopted by the cooperation of the screws and nuts, are disposed between the two intersections for sliding along the two slots 231,241, thereby adjusting a height level and a slope level of the desk board 21 via tightening and loosening the fasteners 25,25'.

Further, the upper frame 23 and the lower frame 24 also have respective positioning zones 26 defined along the circumferences thereof, and each of the positioning zones 26 provides with a plurality of positioning apertures 261 for allowing positioning stems 262 to pass through. Still further, a plurality of side holes 28 are equidistantly spaced on the upper frame 23 and the lower frame 24, so that a side board 281 is positioned between the supporting legs 22 via fixing a fastening unit 282 into each side hole 28. In addition, the upper frame 23, the lower frame 24 or both of them can have a side panel 3 fixed thereto. It is adopted in the preferred embodiments that the lower frame 24 has the side panel 3 disposed thereon to achieve the beauty and the sustaining purpose. The side panel 3 further provides a plurality of openings 31 defined thereon, where users can freely hang personal articles, thus more increasing the convenience.

Figure 2:
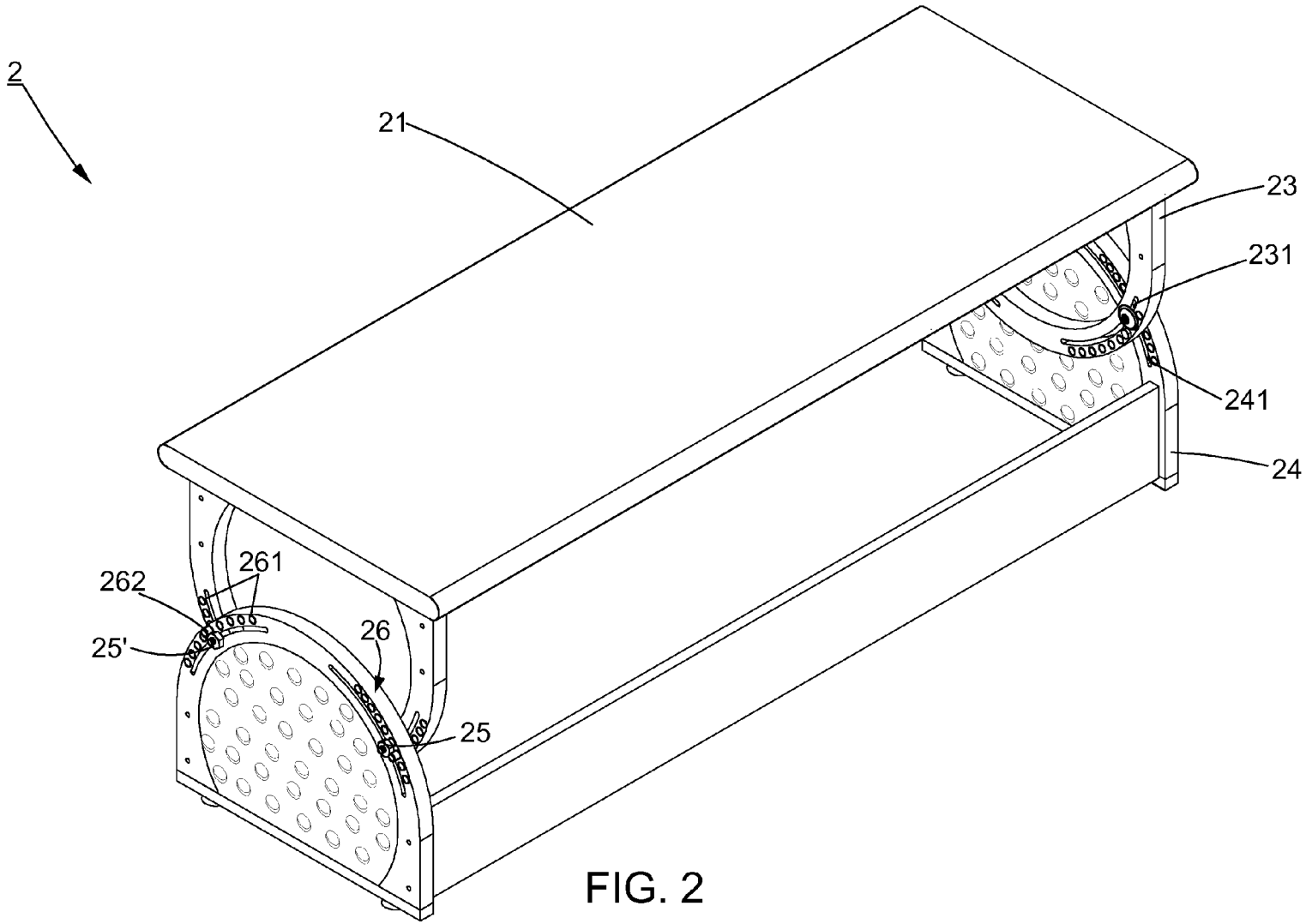
FIG. 2 is a perspective view showing the integral appearance of the first preferred embodiment.

Referring to FIG. 2, with respect to the sales, the industry would predetermine the desk 2 at the certain height. While mounting, separately align the positioning apertures 261 on the two positioning zones 26 of the upper frame 23 with the apertures 261 of the two zones 26 of the lower frame 24 by inserting the positioning stems 262 through those intersecting apertures 261, so as to maintain the upper frame 23 at a certain height level and also cause the communication of the first and the second slots 231,241. In this manner, by means of the fasteners 25, 25' to be screwed between the intersections of the slots 231,241, the upper frame 23 hence is firmly fastened to the lower frame 24. By following the same procedures, the height of the other upper frame 23 balances the height of the previous upper frame 23, thus keeping the desk board 21 in a parallel state and accomplishing the height adjustment of the adjustable desk 2.

Figure 3:
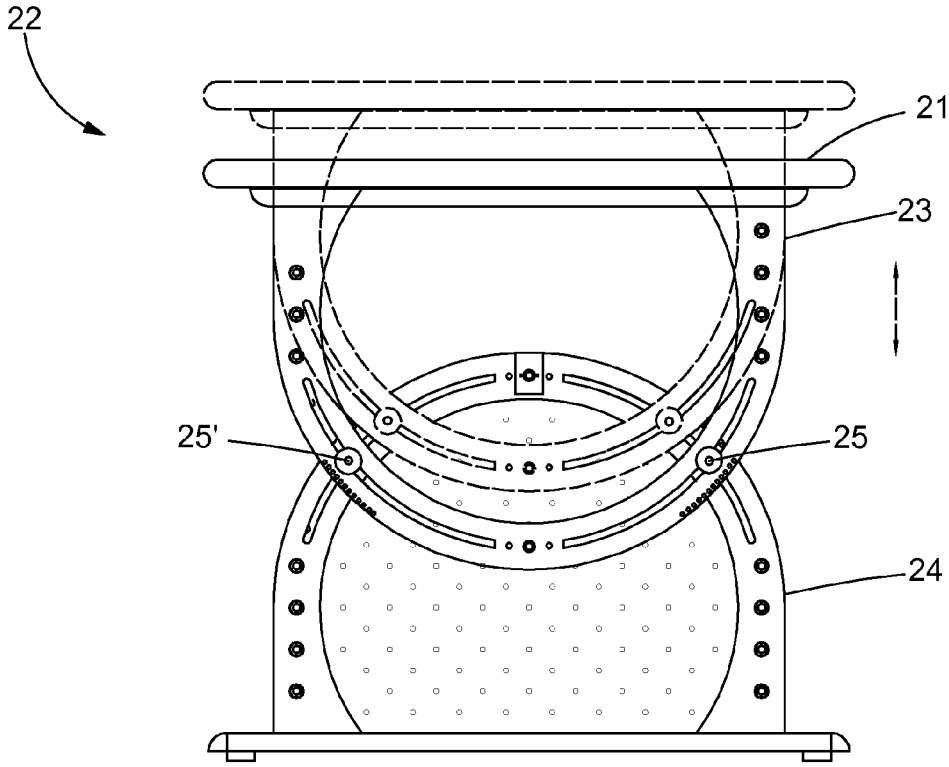
FIG. 3 is a schematic view showing the first preferred embodiment in operation.
Figure 4:
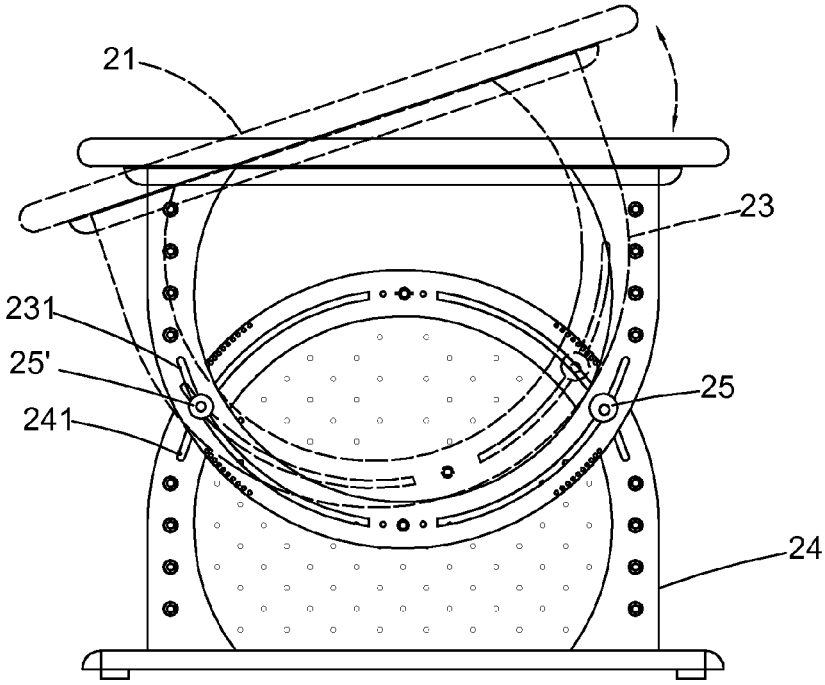
FIG. 4 is another schematic view showing the first preferred embodiment in operation.

Continuing with the aforementioned, users can alternatively have the adjustment by themselves. For the purpose of the height adjustment, users can either loosen the fasteners 25,25' of the supporting leg 22 for directly raising and descending the upper frame 23 and the desk board 21 (as arrowed in FIG. 3) or indirectly drive the upper frame 23, that is, users loosen only one fastener 25 of the supporting leg 22, pivot on the other non-loosened fastener 25' for permitting one side of the upper frame 23 to perform in upward and downward movements by the loosened fastener 25 slidably moving in the slots 231,241 (as arrowed in FIG. 4), and then tighten the fastener 25 between the two intersections to position the upper frame 23 with the lower frame 24 at the desired height. Contrarily, the primary loosened fastener 25 is then served as a pivot for adjusting the other side of the upper frame 23 at the same height level. Subsequently, the other supporting leg 22 follows the same procedures, whereby the desk board 21 can keep in balance and match users demands. For the purpose of the slope adjustment, users simply control the upper frame 23 to become swinging and decline toward one side while the upper frame 23 is in the upward and downward movements and fasten the fasteners 25, 25' into the slots 231, 241, thereby maintaining the desk board 21 at the desired slope.

Figure 5:
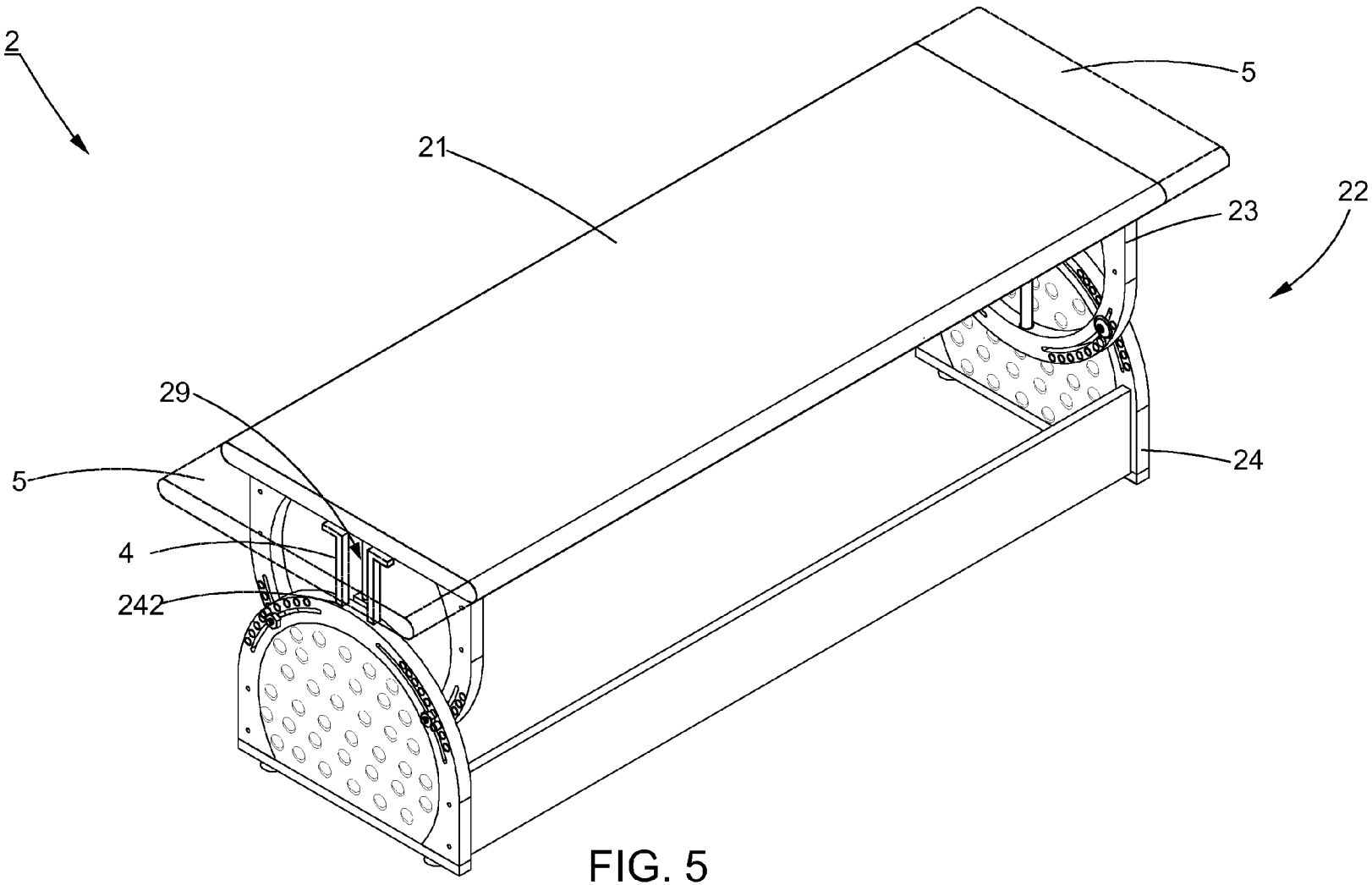
FIG. 5 is a perspective view showing a second preferred embodiment of the present invention.
Figure 6:
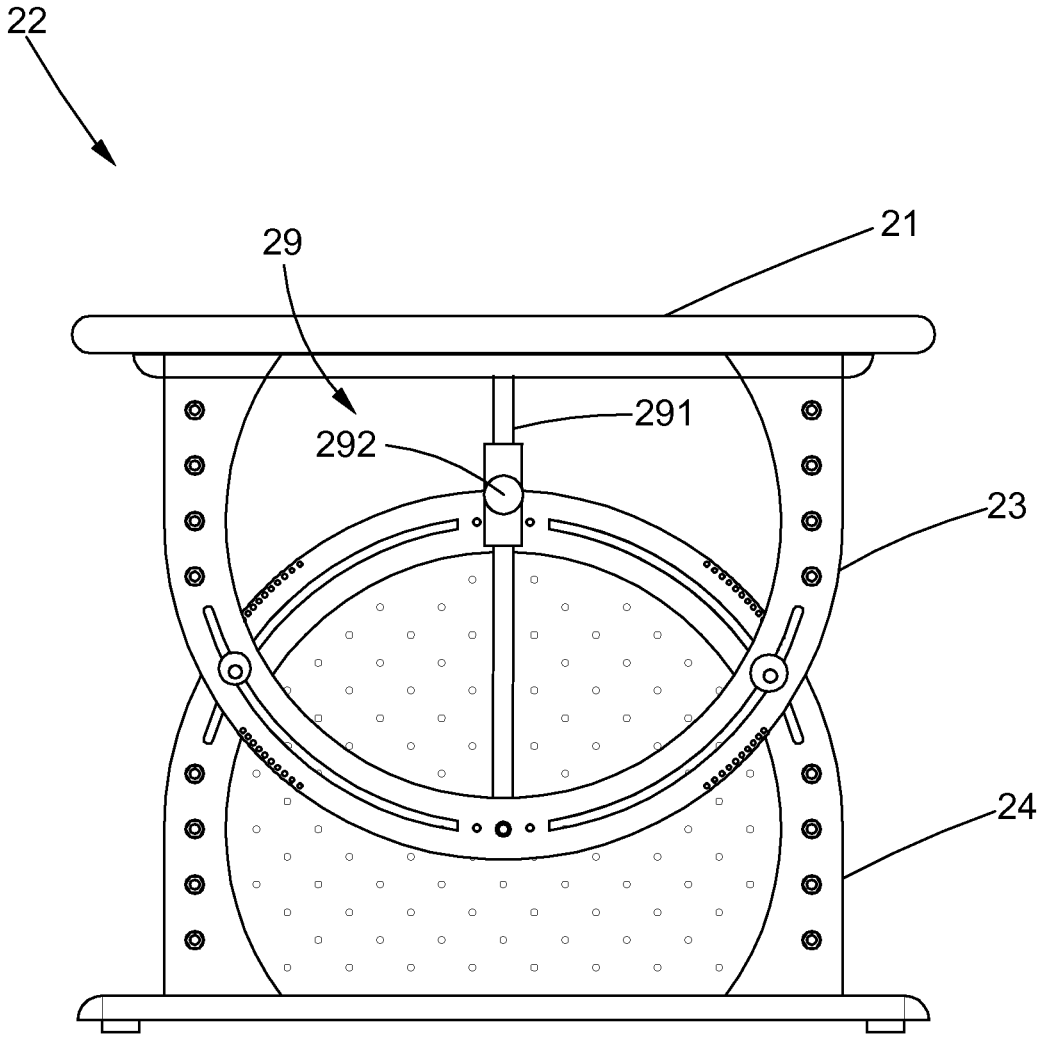
FIG. 6 is a plan view showing the second preferred embodiment.

Referring to FIG. 5, another preferred embodiment of the present invention mainly comprises the concatenation of elements and the operations as the same as the previous preferred embodiment. Particularly, each supporting leg 22 additionally dispose an adjustable apparatus 29 which provides with an adjustable stem 291 secured to the upper frame 23 and an adjustable member 292 pivoted on the lower frame 24 for driving and positioning the upper frame 23 (precisely shown in FIG. 6). In addition, a plurality of inserting holes 242, for instance of two holes in FIG. 5, are formed on the lower frame 24 to allow inserting bars 4 to be embedded therein, whose ends further fasten to a side plate 5, thereby extending the working or studying space.

Figure 7:
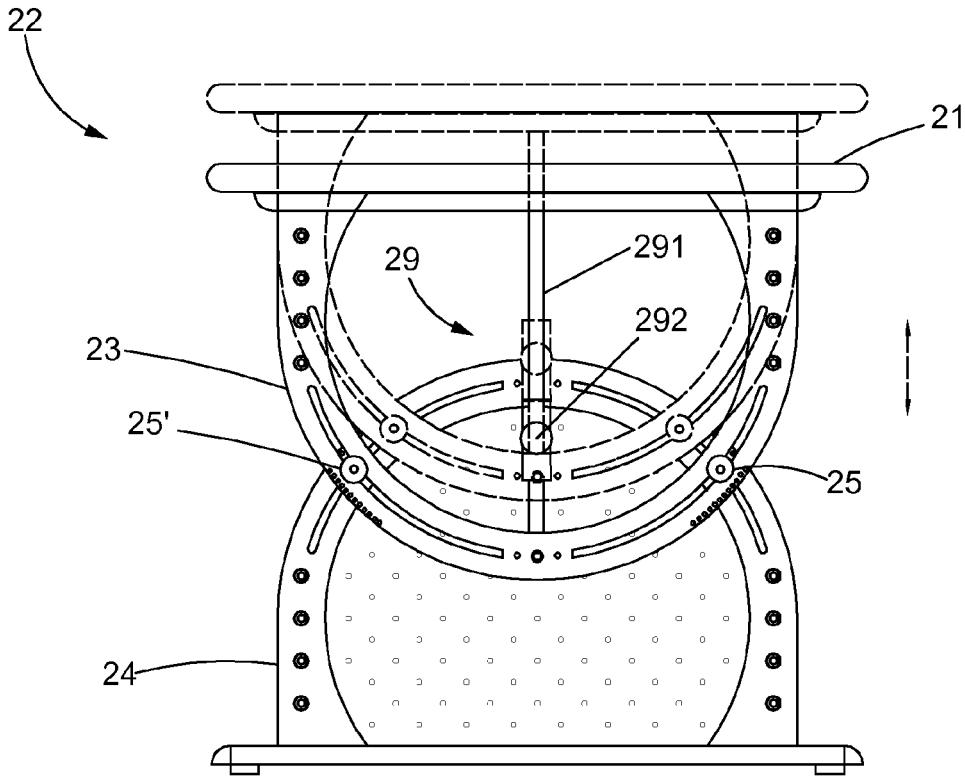
FIG. 7 is a schematic view showing the second preferred embodiment in operation.
Figure 8:
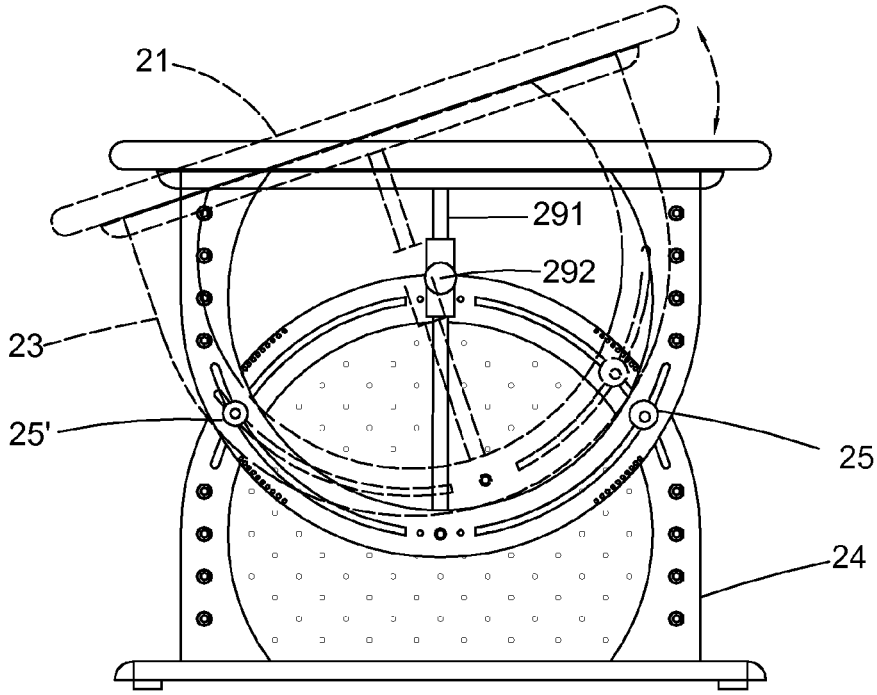
FIG. 8 is another schematic view showing the second preferred embodiment in operation.

Further referring to FIGS. 7 and 8, the height and slope adjustments are still as the same as the previous embodiment. Particularly, users need to loosen the fasteners 25, 25' and the adjustable member 292 and then grasp the adjustable stem 291 to straight control the movement of the upper frame 23 and serve the height and slope adjustments of the desk board 21, therefore more increasing the using convenience.

To sum up, the present invention takes advantages of the supporting legs each with an upper frame, a lower frame and fasteners for positioning the frames. The above frames also have respective slots so that users can simply raise and tilt the desk board at the desired height and slope ranges by tightening or loosening fasteners through the slots; Further, the supporting leg can has an adjustable apparatus for an easy grasp, thus more increasing the using convenience.

While we have shown and described the embodiment in accordance with the present invention, it should be clear to those skilled in the art that further embodiments may be made without departing from the scope of the present invention.

I claim:

1. An adjustable desk comprising a desk board and a pair of supporting legs separately extending from both sides of said desk board; each of said supporting legs further including:

an upper frame fastened to said desk board, wherein, said upper frame having a first slot defined thereon and a first positioning zone formed between said first slot and a circumference of said upper frame, so that a plurality of first positioning apertures being equidistantly spaced on said first positioning zone;

a lower frame pivotally mounted on said upper frame, wherein, said lower frame having a second slot defined thereon and a second positioning zone formed between said second slot and a circumference of said lower frame, so that a plurality of second positioning apertures equidistantly spaced on said second positioning zone; said first slot and said second slot intersecting with each other and forming two intersections while overlapping said upper frame and said lower frame; said first positioning apertures being communicated with said second positioning apertures for allowing positioning stems to penetrate therethrough;

a plurality of fasteners connecting said upper frame and said lower frame, wherein, said fasteners being able to insert between said two intersections and slidably move within said first slot and said second slot, thereby adjusting said desk board at a certain height and slope levels; and an adjustable apparatus disposed thereon said supporting legs, wherein said adjustable apparatus provides with an adjustable stem secured to said upper frame and an adjustable member pivoted on said lower frame, and said adjustable stem is driven and positioned by said adjustable member.

2. The adjustable desk as claimed in claim 1, wherein, a plurality of inserting holes are formed on said lower frame for permitting inserting bars to be embedded therein, and said inserting bars have their ends fasten to a side plate.

3. The adjustable desk as claimed in claim 1, wherein, a plurality of side holes are equidistantly spaced on said upper frame and said lower frame, and a side board is fastened and located between said supporting legs via screwing a fastening unit into each of said side holes.

4. The adjustable desk as claimed in claim 1, wherein, said upper frame has a side panel fixed thereto, and said side panel provides with a plurality of openings defined thereon.

5. The adjustable desk as claimed in claim 1, wherein, said lower frame has a side panel fixed thereto, and said side panel provides with a plurality of openings defined thereon.

* * * * *